United States Patent [19]

Baldwin et al.

[11] Patent Number: 4,762,552

[45] Date of Patent: Aug. 9, 1988

[54] IMPROVED PROCESS FOR BENEFICATING IRON-CONTAINING TITANIFEROUS ORES

[75] Inventors: Roger A. Baldwin, Oklahoma City; William C. Laughlin, Edmond; Keshav P. Patel, Oklahoma City; Patricia J. Shreve, Edmond, all of Okla.

[73] Assignee: Kerr-McGee Chemical Corporation, Oklahoma City, Okla.

[21] Appl. No.: 61,958

[22] Filed: Jun. 15, 1987

[51] Int. Cl.[4] ..... C22B 1/06

[52] U.S. Cl. ..... 75/1 T; 75/115; 75/101 R; 423/69; 423/71; 423/82

[58] Field of Search ..... 423/69, 71, 82; 75/1 T, 75/115, 101 R

[56] References Cited

U.S. PATENT DOCUMENTS 3,777,013 12/1973 Soverini et al. ..... 75/1 T
4,197,276 4/1980 Tolley et al. ..... 423/82
4,288,417 9/1981 Rahm et al. ..... 423/82
4,435,365 3/1984 Morris ..... 423/82

FOREIGN PATENT DOCUMENTS 228396 5/1958 Australia ..... 423/82

*Primary Examiner*—Patrick P. Garvin
*Assistant Examiner*—Paige C. Harvey
*Attorney, Agent, or Firm*—William G. Addison; John P. Ward

[57] ABSTRACT

The beneficiation or upgrading of an iron-containing titaniferous ore to a synthetic rutile by subjecting the ore to reduction followed by acid leaching of the reduced ore is improved by forming a mixture of the ore and an aqueous sulfuric acid solution, adding a reducing agent to this mixture and then subjecting this mixture containing the reducing agent to reduction at elevated temperatures. The resulting reduced ore, which is characterized by an increase in the ferrous iron content thereof and an increase in its specific surface area, exhibits an enhanced response to subsequent acid leaching to provide a synthetic rutile of improved purity.

7 Claims, No Drawings

IMPROVED PROCESS FOR BENEFICATING IRON-CONTAINING TITANIFEROUS ORES

FIELD OF THE INVENTION

The present invention relates to an improved process for the benefication of iron-containing titaniferous ores, including ilmenites. More particularly, the present invention relates to an improved process wherein the titaniferous ore is subjected to reduction in the presence of sulfuric acid and a reducing agent followed by acid leaching with a mineral acid.

BACKGROUND OF THE INVENTION

Many hydrometallurgical processes have been proposed and employed for the beneficiation or upgrading of iron-containing titaniferous ores. One such process, particularly suited to the beneficiation or upgrading of those iron-containing titaniferous ores known as ilmenites, involves first subjecting an ilmenite sand or ore to reduction in the presence of a suitable reducing agent followed by acid leaching of the reduced ilmenite with a mineral acid. The resulting beneficiated or upgraded ilmenite, usually referred to as "synthetic rutile", generally is low in iron and high in titanium dioxide content. This "synthetic rutile" has found wide acceptance and use as a substitute for natural rutile, particularly for use in the manufacture of pigmentary titanium dioxide.

Not all iron-containing titaniferous ores, and particularly not all ilmenites, respond equally to the above reduction and acid leaching process. As a result not all iron-containing titaniferous ores, and particularly not all ilmenites, can be beneficiated or upgraded by this process to a synthetic rutile of a quality acceptable for use in the manufacture of pigmentary titanium dioxide. For example, while weathered ilmenite ores which are characterized by their low ratios to ferrous to total iron (i.e., the total of the ferrous and ferric iron species in the ore) and high specific surface areas respond well to reduction and subsequent acid leaching, nonweathered ilmenite ores which are characterized by significantly higher ratios of ferrous to total iron and lower specific surface areas do not. Thus, a need exists for an improved reduction and acid leaching process for beneficiating or upgrading those iron-containing titaniferous ores which do not ordinarily respond satisfactorily to the conventional reduction and acid leaching process. The present invention has been found to provide such an improved process.

SUMMARY OF THE INVENTION

In accordance with the present invention, improvements are provided in processes for the beneficiation or upgrading of iron-containing titaniferous ores where in said processes the iron-containing titaniferous ore is first subjected to reduction in the presence of a suitable reducing agent at elevated temperatures and the reduced ore then subjected to acid leaching with a mineral acid at elevated temperatures and pressures.

The improvements comprise forming a mixture of the iron-containing titaniferous ore to be beneficiated or upgraded and a quantity of sulfuric acid, adding a reducing agent to this mixture and subjecting the mixture containing the reducing agent to reduction whereby a reduced ore having an improved response to acid leaching is produced.

DETAILED DESCRIPTION OF THE INVENTION

It now has been discovered that the response of iron-containing titaniferous ores to beneficiation or upgrading by acid leaching to remove the iron therefrom can be improved through the use of the improvements of the present invention. Ilmenite ores and especially nonweathered ilmenite ores are particularly receptive to beneficiation or upgrading employing the improvements of the present invention.

In general, the iron-containing titaniferous ores and particularly the ilmenite ores that can be treated in accordance with the improvements of this invention will be those ores which contain from about 35 to about 70 weight percent of titanium dioxide and from about 25 to about 40 weight percent of iron in the form of ferric ($Fe^{3+}$) and ferrous ($Fe^{2+}$) oxides. These ores can be classified as weathered or nonweathered depending upon the weight percent of the ferrous iron to the total iron present in these ores. For example, in weathered ores the weight percent of the ferrous iron to the total iron in such ores is low as a result of the ferrous iron in said ores having undergone substantial oxidation in the ore's natural environment. In nonweathered ores this percentage will be high indicating relatively little natural oxidation of the ferrous iron. Most usually the weight percent of the ferrous iron to the total iron present in weathered ores will range from about 10 to about 50 weight percent while in nonweathered ores this percentage will range from about 50 to about 90 weight percent.

A further characteristic difference between weathered and nonweathered iron-containing titaniferous ores is the difference in specific surface area of these respective ores. For example, examination of weathered and nonweathered ilmenite ores revels a significantly larger specific surface area for the former as opposed to the latter. In general, it has been found that the specific surface area of weathered ilmenite ores will range from about 7.0 to about 12.0 square meters per gram ($m^2/g$) whereas for nonweathered ilmenite ores the specific surface area will be less than about 2.0 $m^2/g$.

As noted hereinabove, the improvements of the present invention provide for an enhancement in the response of iron-containing titaniferous ores including ilmenite ores and especially substantially nonweathered ilmenite ores to beneficiation or upgrading to acid leaching to provide a high titanium dioxide content and low iron content "synthetic rutile." The improvements which have been discovered to enhance this response comprise (1) forming a mixture of the iron-containing titaniferous ore to be subjected to beneficiation or upgrading with a sulfuric acid solution having a free acid content or concentration ranging from about 50 to about 98 weight percent and preferably from about 90 to about 98 weight percent, (2) adding a reducing agent as described hereinbelow to this mixture and then (3) subjecting this mixture containing the reducing agent to reduction conditions as hereafter described.

For purposes of this invention, the iron-containing titaniferous ore and sulfuric acid solution will be mixed together in amounts sufficient such that after reduction of the iron-containing titaniferous ore in the mixture, the ore will exhibit an enhanced response to acid leaching. The amount of the sulfuric acid solution mixed with the iron-containing titaniferous ore will be determined by the free acid content or concentration of the sulfuric acid in the solution and further will be based on the weight of the iron-containing titaniferous ore. In general, the amount of the sulfuric acid solution employed will be an amount sufficient to provide from about 2.0 to about 8.0 weight percent of free sulfuric acid based on the weight of the iron-containing titaniferous ore. While larger amounts of free sulfuric acid can be employed, no significant further improvement in the responsiveness of the iron-containing titaniferous ore to subsequent acid leaching is achieved.

The particular hydrometallurgical process for the beneficiation or upgrading of iron-containing titaniferous ores and especially ilmenite ores to which the improvements comprising the present invention are applicable, can be any conventional process used for the beneficiation or upgrading of iron-containing titaniferous ores and comprised of two basic operational steps or stages. The first step or stage in the conventional processes to which the present invention is applicable is a reduction step or stage wherein that portion of the iron present in the ore in the ferric ($Fe^{3+}$) oxidation state (i.e., as ferric oxide) substantially is reduced to the ferrous ($Fe^{2+}$) oxidation state (i.e., as ferrous oxide). The reasons for converting the ferric oxide in the ore to ferrous oxide is that the latter is known to be more easily removed than ferric oxide in the subsequent acid leaching step or stage and, in addition, only requires about two-thirds of the acid to affect its removal.

This reduction of the iron-containing titaniferous ore is carried out at elevated temperatures generally in the range of from about 600° C. to about 1100° C. in the presence of the reducing agent. More usually, temperatures within the range of from about 650° C. to about 1000° C. will be employed with temperatures between about 900° C. and about 1000° C. being most preferred. The reduction can be performed in any of the known furnaces or rotary kilns available for such purposes.

As noted hereinabove, this reduction step or stage will be conducted in the presence of a reducing agent which will promote the substantial conversion of that portion of the iron present in the ore in the ferric ($Fe^{3+}$) oxidation state to iron in the ferrous ($Fe^{2+}$) oxidation state. In general, reducing agents that have been used in promoting the reduction of iron-containing titaniferous ores have been carbon-based materials. Representative, but nonlimiting, examples of such carbon-based materials include coal, coke, fuel oils, gaseous hydrocarbons containing from one to four carbon atoms, partially burned natural gas, and the like. In addition to these carbon-based materials, hydrogen and hydrogen-containing mixtures, such as water gas, can or have been, employed to promote the substantial conversion of that portion of the iron in the ore undergoing beneficiation in the ferric ($Fe^{3+}$) oxidation state to iron in the ferrous ($Fe^{2+}$) oxidation state. The amount of any of these reducing agents used in affecting this conversion can range from about 2 to about 10 weight percent based on the weight of the iron-containing titaniferous ore to be reduced.

The second step or stage in the conventional processes to which the improvements constituting the present invention is applicable is an acid leaching step or stage wherein the reduced iron-containing titaniferous ore is leached with a dilute aqueous acid solution of a mineral acid such as hydrochloric acid, sulfuric acid, and the like. Most usually, the preferred mineral acid for use in this leaching step or stage is hydrochloric acid. In general, the free acid content of the dilute aqueous acid solution will range from about 15 to about 20 weight percent of the total weight of the acid solution and preferably from about 17 to about 19 weight percent. For the purposes of this second step or stage, the reduced iron-containing titaniferous ore and dilute aqueous acid solution are mixed together in such proportions as to provide an amount of free acid in said mixture in excess of that stoichiometrically required to dissolve and remove the iron values present in the reduced ore. Usually, the amount of the free acid will range from about 10 to about 40 weight percent and preferably, from about 18 to about 30 weight percent in excess of the stoichiometric requirement.

The leaching of the reduced ore with the dilute acid solution usually is carried out in a digestion zone under conditions of elevated temperatures in the range of from about 120° C. to about 150° C. and elevated pressures ranging from about 10 to about 45 pounds per square inch gauge (psig). Preferred leaching temperatures and pressures are those temperatures ranging from about 130° C. to about 145° C. and those pressures ranging from about 18 to about 38 psig, respectively.

Applying the improvements of the present invention to hydrometallurgical processes for the beneficiation or upgrading of iron-containing titaniferous ores, such as the basic two-step or two-stage process described above, it has been observed that the response of such ores and particularly nonweathered ilmenite ores to such a process can be enhanced. The following nonlimiting examples are presented as being illustrative of the practice of the present invention. In these examples, all percentages are by weight unless indicated otherwise.

EXAMPLES 1–5

A series of five beneficiation or upgrading experiments were carried out using both nonweathered and weathered ilmenite ores to demonstrate the efficacy of the present invention. Each of the five experiments was conducted as follows:

A mixture of 100 grams of an ilmenite ore having the analysis set forth in Table I below, a quantity of concentrated sulfuric acid (98 weight percent free acid) and 4 weight percent, based on the weight of the ore, of free oil was prepared and loaded into a quartz tube. The quartz tube, containing the above mixture, was heated to a temperature of 950° C. over a period of three hours and held at this temperature for an additional hour to effect reduction of the ferric iron in the ore to ferrous iron. During this heating period, a synthetic combustion gas mixture was metered through the quartz tube to simulate conditions encountered in a conventional gas fired kiln.

Upon completion of the heating period, the reduced ore was mixed with a 20 weight percent excess of a dilute hydrochloric acid solution (containing 20 weight percent of free acid) and this mixture heated at a temperature of 145° C. for six hours to leach the ferrous iron from the ore. At the end of this time the leached ore was separated from the acid solution, washed, dried and calcined. Data relating to each of the five experiments is set forth in Table II below.

In addition to these five experiments, two comparative experiments were conducted, one using the nonweathered ilmenite ore (Experiment A) and one the weathered ore (Experiment B) to further illustrate the improvements which can be achieved in iron removal. Data relating to these comparative experiments also can be found in the following Table II.

TABLE I

| | Ore Analysis | |
|---|---|---|
| | Non-weathered | Weathered |
| $TiO_2$, % | 50.6 | 58.5 |
| Total Iron, % | 34.2 | 26.2 |
| Ferrous Iron, % | 26.4 | 5.0 |
| Ferrous Iron/Total Iron, % | 77.0 | 19.0 |
| Surface Area, $m^2/g$ | 1.1 | 8.9 |

TABLE II

| | Non-Weathered Ore | | | | | Weathered Ore | |
|---|---|---|---|---|---|---|---|
| | Example No. | | | | | | |
| | 1 | 2 | 3 | 4 | A | 5 | B |
| Mixture | | | | | | | |
| Ore, g | 100 | 100 | 100 | 100 | 100 | 100 | 100 |
| $H_2SO_4$, % | 2 | 5 | 8 | 15 | 0 | 5 | 0 |
| Fuel Oil, % | 4 | 4 | 4 | 4 | 4 | 4 | 4 |
| Thermal Conditions | | | | | | | |
| Temp., °C. | 950 | 950 | 950 | 950 | 950 | 950 | 950 |
| Time @ Temp., hr. | 1 | 1 | 1 | 1 | 1 | 1 | 1 |
| Reduced Ore | | | | | | | |
| Total Iron, % | 90.7 | 91.4 | 94.2 | 91.0 | 87.4 | 95.1 | 94.7 |
| Surface Area, $m^2/g$ | 6.0 | 6.3 | 6.1 | 8.0 | 1.3 | 11.8 | 9.0 |
| Leached Ore | | | | | | | |
| Total Iron, % | 3.6 | 3.5 | 3.6 | 3.7 | 6.7 | 2.9 | 3.1 |
| $TiO_2$, % | 93.2 | 93.4 | 93.6 | 93.5 | 88.7 | 94.9 | 94.6 |

While the present invention has been described with regard to specific embodiments thereof, it is to be understood that changes and modifications can be made thereto without departing from the spirit and scope of the invention.

What is claimed is:

1. In a process for beneficiating an iron-containing titaniferous ore wherein the titaniferous ore is subjected to reduction in the presence of at least one reducing agent at a temperature of from about 600° C. to about 1100° C. and wherein the reduced ore is subjected to leaching with a hydrochloric acid solution at a temperature of from about 120° C. to about 150° C., the improvement which comprises:

forming a mixture of the titaniferous ore and a sulfuric acid solution said acid solution having a sulfuric acid concentration of from about 50 to about 98 weight percent based upon the total weight of the solution;

adding the reducing agent to the mixture; and subjecting the mixture, containing the reducing agent to reduction.

2. The improvement of claim 1 wherein the iron-containing titaniferous ore is an ilmenite ore containing from about 25 to about 40 weight percent of iron.

3. The improvement of claim 2 wherein the ilmenite ore is a nonweathered ilmenite ore containing iron both as ferrous iron and ferric iron, wherein the weight percent of ferrous iron to total iron present in the ilmenite ore ranges from about 50 to about 90.

4. The improvement of claim 1 wherein the sulfuric acid solution contains a sulfuric acid concentration of from about 90 to about 98 weight percent.

5. The improvement of claim 1 wherein the reducing agent is at least one material selected from the group consisting of carbonaceous reducing agents and hydrogen.

6. The improvement of claim 1 wherein the hydrochloric acid solution employed in the leaching of the reduced ore contains a hydrochloric acid concentration of from about 15 to about 20 weight percent.

7. The improvement of claim 1 wherein the sulfuric acid solution is mixed with the iron-containing titaniferous ore in an amount sufficient to provide from about 2 to about 8 weight percent of sulfuric acid based on the weight of the iron-containing titaniferous ore.

* * * * *